US010766295B2

(12) United States Patent
Schmidegg et al.

(10) Patent No.: US 10,766,295 B2
(45) Date of Patent: Sep. 8, 2020

(54) SECURITY ELEMENT AND VALUE DOCUMENT HAVING SAID SECURITY ELEMENT

(71) Applicants: Hueck Folien Gesellschaft M.B.H., Baumgartenberg (AT); Banque de France, Paris (FR)

(72) Inventors: Klaus Schmidegg, Gleisdorf (AT); Sonja Landertshamer, Linz (AT); Fabrice Capiez, Ceyrat (FR); Olivier Martin, Chamalières (FR); Roger Vilcot, Pérignat-lès-Sarliève (FR); Michel Blanc, Aubière (FR)

(73) Assignees: Hueck Folien Gesellschaft M.B.H, Baumgartenberg (AT); Banque de France, Paris (FR)

( * ) Notice: Subject to any disclaimer, the term of this patent is extended or adjusted under 35 U.S.C. 154(b) by 0 days.

(21) Appl. No.: 16/339,662

(22) PCT Filed: Oct. 4, 2017

(86) PCT No.: PCT/EP2017/075260
§ 371 (c)(1),
(2) Date: Apr. 4, 2019

(87) PCT Pub. No.: WO2018/065493
PCT Pub. Date: Apr. 12, 2018

(65) Prior Publication Data

US 2019/0232710 A1 Aug. 1, 2019

(30) Foreign Application Priority Data

Oct. 4, 2016 (EP) ..... 16192283

(51) Int. Cl.
*B42D 25/387* (2014.01)
*B42D 25/328* (2014.01)
(Continued)

(52) U.S. Cl.
CPC ..... *B42D 25/387* (2014.10); *B42D 25/324* (2014.10); *B42D 25/328* (2014.10); *B42D 25/351* (2014.10)

(58) Field of Classification Search
CPC .. B42D 25/387; B42D 25/351; B42D 25/328; B42D 25/324
(Continued)

(56) References Cited

U.S. PATENT DOCUMENTS

2007/0165182 A1* 7/2007 Hoffmuller ..... B44C 1/14 349/187

FOREIGN PATENT DOCUMENTS

| | | | |
|---|---|---|---|
| DE | 102004053007 | A1 | 5/2006 |
| EP | 1241022 | A1 | 9/2002 |
| WO | 2015095976 | A1 | 7/2015 |

* cited by examiner

*Primary Examiner* — Justin V Lewis

(57) ABSTRACT

A value document having a security element in the form of a strip with a first polymer layer which comprises at least one embossed diffraction structure, having at least one reflection layer which visually interacts with the diffraction structure in order to form a reflection hologram as the first visually recognisable security feature, and having at least one imprint which is luminescent under UV radiation and which forms a second security feature that is visually recognisable under UV light, wherein the reflection hologram comprises at least one see-through region on the second security feature. In order to increase the level of protection against forgery of the security element, the luminescent imprint comprises a halftone print image, and the see-through region is formed by at least one recess in the reflection layer and by the polymer layer which is free in this region of the recess from the diffraction structure at least above the halftone print image of the imprint.

15 Claims, 4 Drawing Sheets

(51) Int. Cl.
*B42D 25/351* (2014.01)
*B42D 25/324* (2014.01)

(58) Field of Classification Search
USPC ..... 283/72, 74, 94, 98, 901
See application file for complete search history.

SECURITY ELEMENT AND VALUE DOCUMENT HAVING SAID SECURITY ELEMENT

FIELD OF THE INVENTION

The invention relates to a security element in the form of a strip having a first polymer layer which comprises at least one embossed diffraction structure, at least one reflection layer which optically interacts with the diffraction structure in order to form a reflection hologram as a first visually recognisable security feature, and at least one imprint which is luminescent under UV radiation and which forms a second security feature that is recognisable under UV light, wherein the reflection hologram comprises at least one see-through region on the second security feature.

BACKGROUND OF THE INVENTION

In order to supplement a reflection hologram with a second security feature, security elements are known from the prior art (EP 1 241 022 A1) which allow an imprint that is luminescent under UV radiation to shine through with a partly transparent reflection layer on the reflection hologram. The reflection hologram thus comprises a see-through region on the imprint that is luminescent under UV radiation, which increases the protection against forgery of the security element. Both security features, namely the reflection hologram and the imprint, visually impair each other in a disadvantageous manner, which renders the optical separability of the security features more difficult and can lead to a reduction in the level of protection against forgery.

SUMMARY OF THE INVENTION

It is the object of the invention to increase the protection against forgery of a security element with at least two security features.

This object is achieved by the invention in such a way that the luminescent imprint comprises a halftone print image and the see-through region is formed by at least one recess in the reflection layer and by the polymer layer which is free in this region of the recess from the diffraction structure at least above the halftone print image of the imprint.

If the luminescent imprint comprises a halftone print image, it is possible to create a security feature on the security element which offers the highest level of protection against forgery. In order to prevent impairing said increased protection against forgery by optical disturbances such as Moiré patterns, the invention further proposes that the see-through region is formed by at least one recess in the reflection layer and by the polymer layer which is free in this region of the recess from the diffraction structure at least above the halftone print image of the imprint. As a result, the isotropic fluorescent radiation of the luminescent halftone print image, which is especially susceptible to diffraction-induced distortions, can pass the see-through region in the reflection hologram in a virtually unimpaired manner, so that blurring in the imaging of the visual effect of the second security element is not an issue. Furthermore, visual mixing of the two security elements can be avoided, which can promote an unimpaired visual distinguishability of the two security features.

Furthermore, this see-through region can amplify a spatial depth effect between the two security features on the security element and the protection against forgery of the security element can thus be increased even further.

It is generally mentioned that a halftone print image can be understood as a printed image with a print matrix in which the halftone dots or printed dots can be applied adjacent to each other and on top of each other. An image effect can be produced by colour mixing and/or varying the intensity. Halftone print images can represent images with one or several colours.

It is generally further mentioned that for this imprint that is luminescent under UV radiation a printing ink can be used which contains luminescent dyes or pigments. Said luminescent dye and/or pigment can be brought to an energetically excited state under action of radiation and thereafter spontaneously converge into a state of low energy, wherein photons of a specific wavelength are emitted, which can be perceived by the human eye at a respective wavelength.

It is generally further recognised that the luminescent imprint and/or the halftone print image can be applied with any conventional, e.g. contacting or noncontacting, printing method such as intaglio printing, screen printing, pad transfer printing, offset printing, lithographic printing, flexographic printing, relief printing or inkjet printing etc.

The visual demarcation between the reflection hologram and the imprint luminescent under UV radiation can be amplified even further if the embossed diffraction structure ends on the recess of the reflection layer. Furthermore, depending on the angle of view of the see-through region, a visual effect can thus be produced which is more or less dependent on the diffraction structure, as a result of which the security element can be supplemented by a further security feature. Furthermore, the spatial depth effect can thus be amplified even further. The protection against forgery of the security feature can thus be improved even further.

The likelihood of optical disturbances on the halftone print that are dependent on the angle of view can be reduced considerably when the diffraction structure and the reflection layer are arranged in relation to each other in the register.

If the recess and the halftone print image are arranged in relation to each other in the register, it can be prevented at first that motif components of the imprint are covered by the reflection layer of the reflection hologram. It can further be achieved that when viewing the security element from the imprint side the visual impression of the halftone print image remains unimpaired by the reflection layer. Furthermore, it is possible to reduce the visual standing out of the luminescent halftone print image from other regions in the see-through region under white light or daylight, e.g. in that differences in the opacity in the see-through region are avoidable. In the see-through region, the luminescent imprint, when viewed under white light, can be recognised as such only with difficulty or it will remain hidden to a higher extent in the security element. This can further increase the protection against forgery of the security element.

The constructive configuration of the security element can be simplified when the recess in the reflection layer covers the luminescent imprint at least in sections. The reflection layer can thus cover the printing edge for example and optionally mask out boundary effects on the halftone print image that may disturb the security element.

The protection against forgery can be increased additionally when the recess is provided in the form of a character, pattern or coding in the reflection layer. The outer contour of the recess can be adjusted among other things to motifs in the luminescent imprint.

The invention is especially distinguished when the reflection hologram comprises a motif and the recesses form a motif portion of the reflection hologram. The recesses can correspond to inverted contours of the motif for example and complement the same by the luminescent imprint under UV radiation. This can further increase the protection against forgery of the security element.

It is further mentioned generally that an imprint can be provided (and be desirable) on the reflection layer outside of the recesses in the reflection hologram. Such an imprint would not be accessible when viewed from the side of the embossed polymer layer. This can represent an additional security feature when it is viewed from the imprint side.

If the halftone print image comprises halftone dots which are luminescent in different colours, a multicoloured luminescent imprint can be created. This multicoloured luminescent imprint can even be formed in true colours when red, green and blue are used as luminescent halftone dots.

A security feature which offers especially good protection against forgery can be created on the luminescent imprint when the halftone print image has a honeycomb grid whose hexagonal grid cells consist of adjacently arranged, triangular halftone dots.

The halftone print image preferably comprises grid cells with a size of 10 to 500 μm, especially 50 to 200 μm.

If the security element has a transparent topcoat layer, the luminescent imprint can stably be protected from external influences. In particular, oxidation of the fluorescent dyes can thus be prevented. The security element can further be protected from mechanical damage of the reflection hologram or from oxidation of the metallic reflection layer. An especially sturdy and stable security element can thus be created in accordance with the invention.

If said transparent topcoat layer is an adhesive layer, the security element can be protected from external influences and can simultaneously be provided in an easy-to-use manner on a value document or a random carrier. It can further be considered that the adhesive layer is applied to an additional transparent topcoat layer.

The adhesive layer can especially be a heat-sealing lacquer layer, a cold-sealing adhesive layer, a self-adhesive coating, a radiation-hardening coating or other comparable coatings.

The practical aspect of the security element can be improved if the security element comprises a carrier film and is thus provided with increased mechanical stability.

The carrier film can preferably also be formed as a transfer carrier in order to additionally promote the practical aspect of the security element for its further use.

The security element in accordance with the invention can especially bring its benefits if it is applied to a substrate of a value document and is materially connected thereto. Value documents to be considered are a banknote, tax stamp, passport, driver's license or ID card for example.

In general, it is stated that the substrate may also have one or more windows for viewing the security element, thus creating a value document with very high protection against forgery.

The protection against forgery of the value document can be improved even further if the luminescent imprint is adjusted visually to the visual appearance of the substrate. As a result, a visually recognisable difference in opacity between the substrate and the luminescent imprint can be avoided, by means of which the same can be hidden in a stable manner in the value document when it is viewed under white light.

If the security element has a transparent cover film, a robust security element can be created which is suitable for embedding in a value document and has different visually recognisable security features when viewed from both sides.

If the security element is embedded in the substrate of the value document and if the substrate comprises at least one window for inspecting the security element, a value document can be created which offers an especially high level of protection against forgery. The embedded security element can then especially be viewed from at least one or from both sides of the substrate and, in the case of a window on both sides, can comprise security features on each side which can be visually recognised in a different way.

Notice is taken in general that the windows in the value document can be arranged in a precise manner with respect to the halftone screen with the security features on the security element.

BRIEF DESCRIPTION OF THE DRAWINGS

The subject matter of the invention is shown in closer detail in the drawings by reference to an embodiment, wherein.

DETAILED DESCRIPTION OF THE PREFERRED EMBODIMENTS

Figure 1:
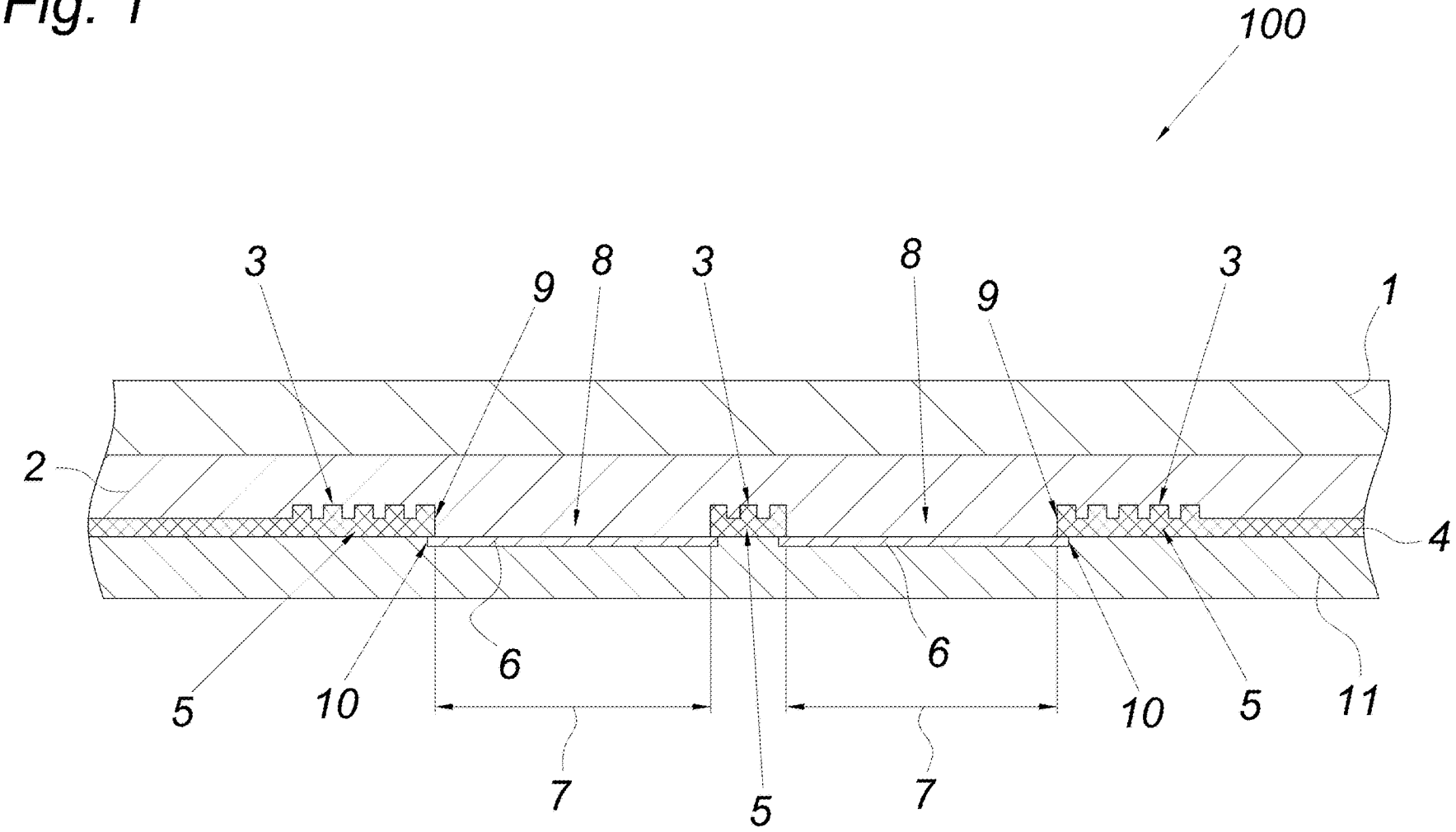
FIG. 1 shows a cross-sectional view through an embodiment of the security element in accordance with the invention.

FIG. 1 shows a security element 100, on which a polymer layer 2, especially a polymerized lacquer layer, is provided. A diffraction structure 3 is embossed in the polymer layer 2, which diffraction structure 3 forms a reflection hologram 5 with a reflection layer 4 provided on the polymer layer 2, which reflection hologram represents the first security feature of the security element 100. An imprint 6 is further applied, which is luminescent under radiation with UV-light. The imprint 6 especially contains luminescent dyes for this purpose. Recesses 7 are provided above the imprint 6 in the reflection layer 4.

Figure 4:
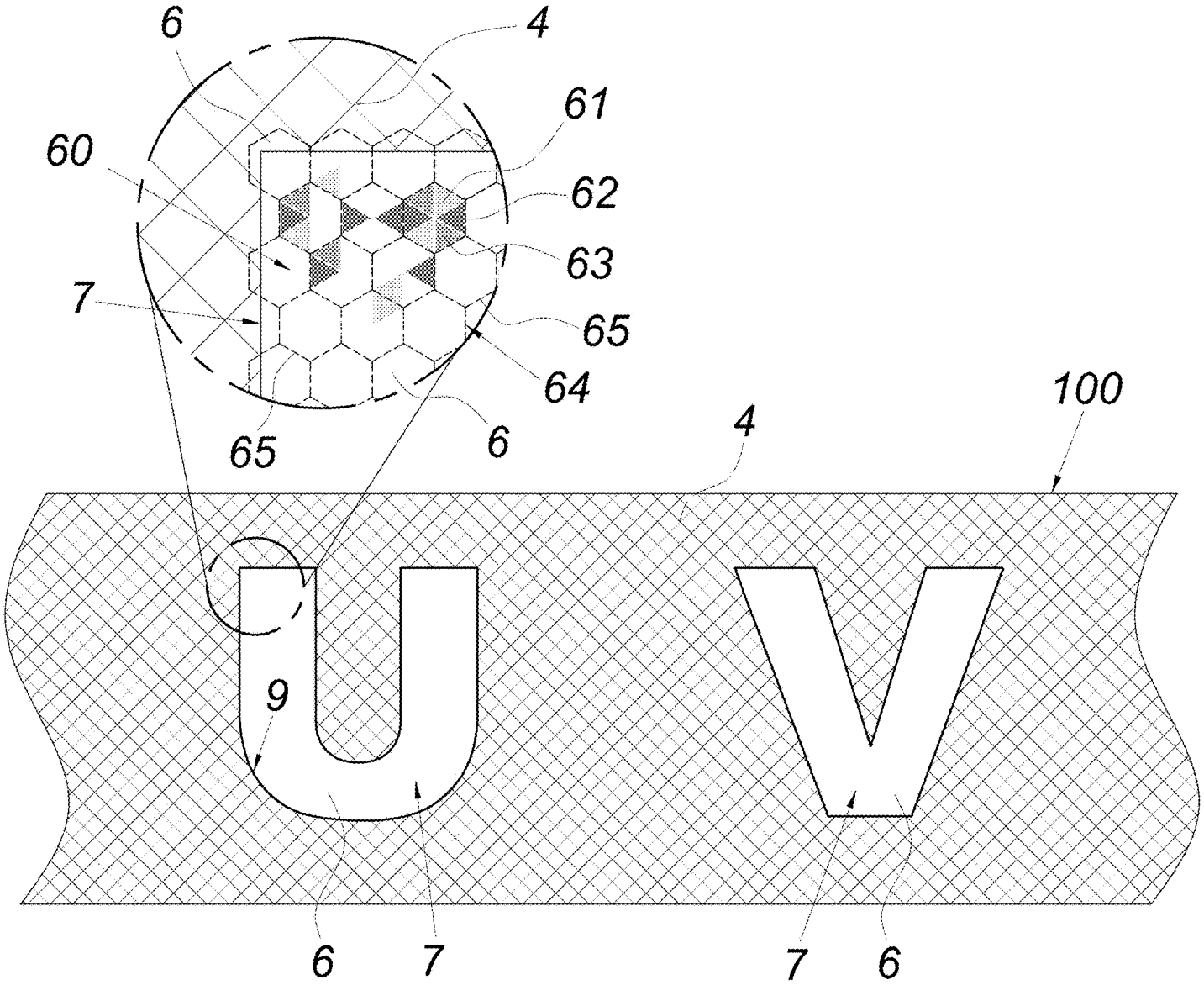
FIG. 4 shows a top view of a security element in accordance with the invention with a detailed view.

The highest level of security is achieved on the security element 100 in accordance with the invention in such a way that the see-through region 8 is formed by at least one recess 7 in the reflection layer 4 and by the polymer layer 2 which is free from the diffraction structure 3 in this region of the recess 7. Only this allows perceiving without distortions a luminescent imprint 6 with a halftone print image 60 which comprises isotropic fluorescent radiation. For this purpose, the recess 7 is provided at least over the halftone print image 60 of the imprint 6, as shown in FIG. 4. This ensures unlimited viewing of the halftone print image 60. The security element 100 can thus be viewed both from the side of the carrier film 1 and also from the side of the imprint 6, thus creating a security element 100 with a high level of protection against forgery.

Figure 2:
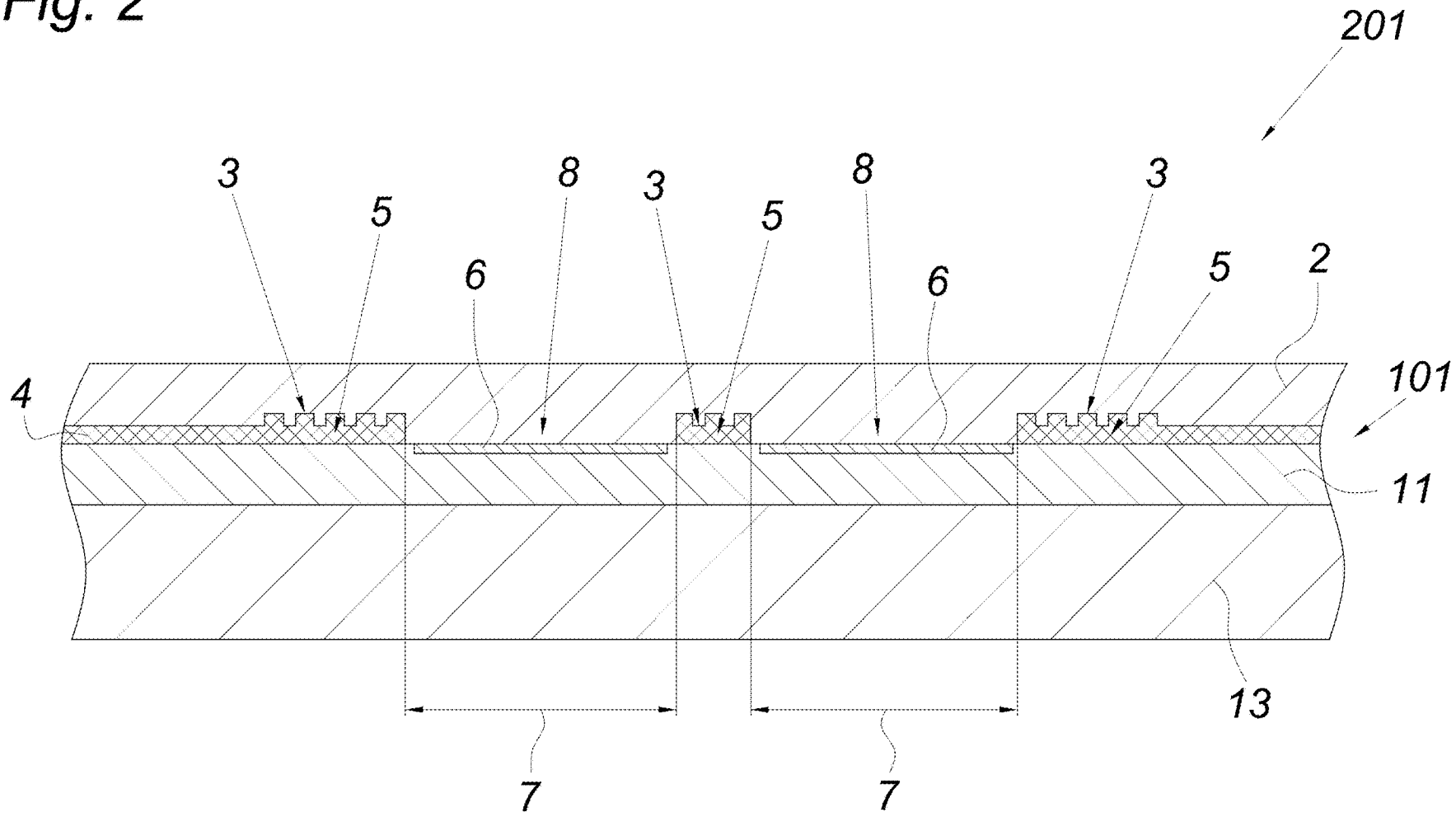
FIG. 2 shows a cross-sectional view through a value document with a further embodiment of the security element.

FIG. 1 further shows that the diffraction structure 3 embossed in the polymer layer 2 ends on the recess 7 of the reflection layer 4. No diffraction structures 3 are introduced into the see-through regions 8 in the first polymer layer 2, so that unobstructed viewing (e.g. an unchanged visual impression of the imprint 6) can be achieved, even in the boundary region. It can thus be prevented that a visual superposition between the diffraction structure 3 and the luminescent imprint 6 occurs in the boundary regions of the see-through regions 8. Furthermore, the imprint 6 is in the register with the see-through region 8 or the recess 7 in the reflection layer 5. For this purpose, the diffraction structure 3 and the reflection layer 4 are advantageously also arranged in the register with respect to each other. The boundary contour 9 of the reflection layer 4 can also slightly cover the boundary contour 10 of the halftone print image 60, i.e. the halftone image 60 can thus also extend minimally beyond the reflection layer 4 behind the diffraction structure 3. This leads to a sharp boundary contour between the luminescent imprint 6 and the reflection hologram 5. It is also possible, as shown in FIG. 2, that the boundary contour 10 of the halftone print image 60 is not covered by the boundary contour of the reflection layer 4 but lies in the region of the recess 7. Visual impairments in the visual perceptibility of the halftone print image 60 can thus be prevented.

As is shown especially in FIG. 4, the halftone print image 60 comprises luminescent halftone dots 61, 62, 63 which have different colours, namely red, green and blue. This leads to a halftone print image 60 which is luminescent in true colour. Furthermore, the halftone print image 60 comprises a honeycomb grid 64, whose hexagonal grid cells 65 consist of triangular points 61, 62, 63 which are arranged adjacent to each other. Said grid cells 65 have a size of 10 to 500 μm, especially 50 to 200 μm.

Furthermore, the boundary contour 9 of the recess 7 in the reflection layer 4 can follow the shape of a character, a pattern or a coding. It has proved to be especially advantageous if the boundary contour 9 of the recess follows or completes a motif generated by the reflection hologram 5. As a result, different motif parts can be recognised under different illumination situations.

The imprint 6 is advantageously covered by a transparent topcoat layer 11, as shown in FIG. 1. The topcoat layer 11 can be formed as a transparent protective lacquer 11, or as an adhesive layer 11, especially as a hot-seal lacquer layer 11. It can also be considered that both a transparent protective lacquer and also the adhesive layer form the topcoat layer 11. Security elements 100, 101, 102 in accordance with the invention can be provided on value documents 201, 202 above the adhesive layer 11, as shown in FIG. 2 and FIG. 3.

Figure 3:
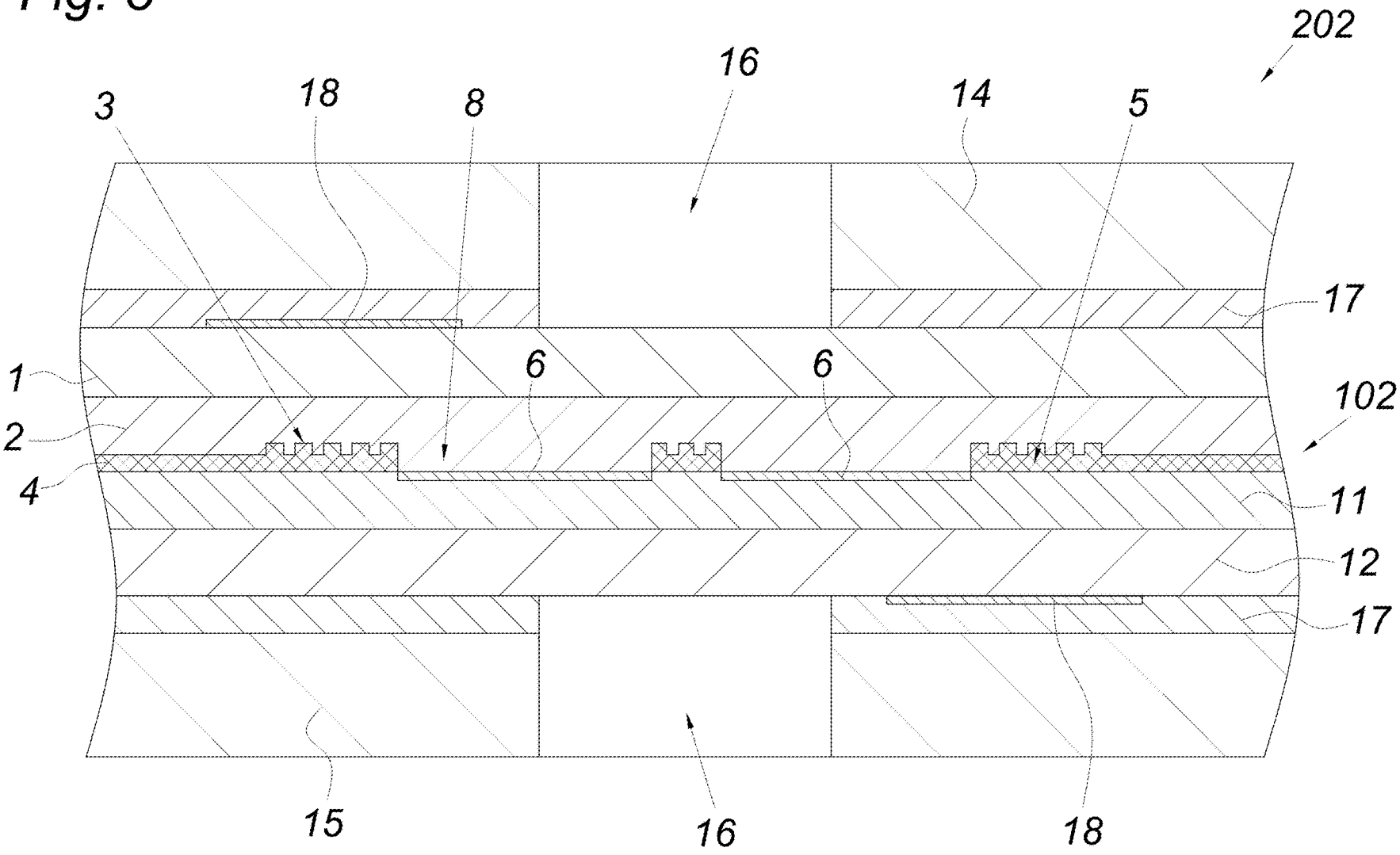
FIG. 3 shows a cross-sectional view through a further value document with a third embodiment of the security element.

A transparent cover film 12 can further be attached to the adhesive layer 11 of the security element 100, 101, 102, as is shown for example in the security element 102 represented in FIG. 3.

In a further embodiment, the polymer lacquer layer 2 is advantageously attached by way of adhesion to a carrier film 1. Such a carrier film 1 can both facilitate the production process of the security element 100, 101, 102, and also improve the stability thereof. Alternatively, the carrier film 1 or the transfer carrier 1 can be provided to be detachable from the polymer lacquer layer 2.

Value documents 201, 202 are shown in FIG. 2 and FIG. 3, wherein a respective security element 101 or 102 is applied to the value documents 201, 202. The value documents 201, 202 can especially concern a banknote, a driver's license, an ID card, a passport or comparable documents in accordance with the invention.

FIG. 2 shows a value document 201, wherein the carrier film 1 (see FIG. 1) was removed from the applied security element 101. The security element 101 was glued by the adhesive layer 11 onto the substrate 13 of the value document 201. The luminescent imprint 6 is visually adjusted to the visual appearance of the substrate 13 of the value document 201.

The value document 202 shown in FIG. 3 comprises a security element 102, onto which a transparent cover film 12 was applied. The security element 102 is embedded between an upper substrate 14 and a bottom substrate 15. Both the upper substrate 14 and also the bottom substrate 15 comprise windows 16 in order to allow direct view at least in part onto the security features of the security element 102. An additional adhesive layer 17, especially a hot-seal lacquer layer, is provided between the security element 102 and the substrate 14, 15 of the value document 202, which are also left open in the region of the windows 16. The carrier film 1 and the transparent cover film 12 of the security element 102 can further be formed to be printable. It can be considered that a print 18, with or without luminescent dyes, is provided in each case on the carrier film 1 and the cover film 12.

In another embodiment of the invention, only one of the substrates 13, 14 has a window 16, which was not shown in detail in the figures.

In addition, in a further embodiment, a value document is created which has a security element 100, 101, 102 which is in accordance with the invention and which is applied to a single substrate 13, wherein the substrate 13 has a window for viewing the security element 100, 101, 102, which, however, is not described in detail in the figures. Such a security element can thus be viewed from two sides and thus increase the protection against forgery.

The invention claimed is:

1. A security element in the form of a strip, comprising:

a polymer layer having at least one embossed diffraction structure;

at least one reflection layer which optically interacts with the at least one diffraction structure in order to form a reflection hologram as a first visually recognisable security feature; and at least one imprint which is luminescent under UV radiation and which forms a second security feature that is recognisable under UV radiation, the at least one luminescent imprint comprising a halftone print image, wherein the reflection hologram comprises at least one see-through region revealing the second security feature, and at least one recess in the at least one reflection layer and the polymer layer together form the at least one see-through region, wherein the polymer layer is free from the at least one diffraction structure in the at least one recess, at least above the halftone print image of the imprint.

2. A security element according to claim 1, wherein the at least one diffraction structure and the at least one reflection layer are aligned in relation to each other in register.

3. A security element according to claim 1, wherein the at least one recess and the halftone print image are aligned in relation to each other in register.

4. A security element according to claim 1, wherein the at least one reflection layer covers a boundary contour of the halftone print image at least in sections.

5. A security element according to claim 1, wherein the at least one recess is provided in the form of a character, pattern or coding in the at least one reflection layer.

6. A security element according to claim 1, wherein the reflection hologram comprises a motif and the at least one recess forms a motif part of the reflection hologram.

7. A security element according to claim 1, wherein for forming a multicolour luminescent imprint the halftone print image comprises halftone dots which are luminescent with different colours selected from the group consisting of red, green and blue.

8. A security element according to claim 7, wherein the halftone print image comprises a honeycomb grid, whose hexagonal grid cells consist of triangular halftone dots which are arranged adjacent to each other and bordering each other.

9. A security element according to claim 7, wherein the halftone prim image comprises grid cells with a size of 10 to 500 μm.

10. A security element according to claim 1, wherein the security element comprises a transparent topcoat layer that is an adhesive layer.

11. A security element according to claim 1, wherein the security element comprises a transparent cover film.

12. A security element according to claim 1, wherein the security element comprises a carrier film formed as a transfer carrier.

13. A value document with a substrate and with at least one security element according to claim 1 provided on the substrate.

14. A value document according to claim 13, wherein the luminescent imprint is visually adjusted to match a visual appearance of the substrate.

15. A value document according to claim 13, wherein the security element is embedded in the substrate, and the substrate comprises at least one window for viewing the security element.

* * * * *